United States Patent [19]

Freitag et al.

[11] 4,423,393

[45] Dec. 27, 1983

[54] HIGH SPEED OCTAVE BAND PHASE SHIFTER

[75] Inventors: Ronald G. Freitag, Ellicott City; Jeffrey A. Kruth, Ferndale Township, Anne Arundel County, both of Md.

[73] Assignee: Westinghouse Electric Corp., Pittsburgh, Pa.

[21] Appl. No.: 345,839

[22] Filed: Feb. 4, 1982

[51] Int. Cl.[3] ..... H01P 1/185; H01P 5/12; H01P 5/04

[52] U.S. Cl. ..... 333/164; 333/139; 333/161

[58] Field of Search ..... 333/156, 157, 160, 161, 333/164, 246, 248, 116, 117, 138–140

[56] References Cited

U.S. PATENT DOCUMENTS 4,105,959 8/1978 Stachejko ..... 333/164 X
4,205,282 5/1980 Gipprich ..... 333/164 X

*Primary Examiner*—Marvin L. Nussbaum
*Attorney, Agent, or Firm*—R. M. Trepp

[57] ABSTRACT

A high speed reflectance type phase shifter is described incorporating a wide bandwidth coupler having four ports, two of the ports having a high speed diode coupled thereacross a resistor coupled in shunt across each diode to provide power dissipation at times the diodes are non-conducting and a current driver to provide bias current to the diodes. The invention provides constant insertion loss through the phase shifter during the on state and off state of the diodes corresponding to the two phase conditions of the output signal without affecting bandwidth.

10 Claims, 3 Drawing Figures

HIGH SPEED OCTAVE BAND PHASE SHIFTER

GOVERNMENT CONTRACT

The Government has rights in this invention pursuant to Contract No. N00019-79-C-0221 awarded by the Department of the Navy.

BACKGROUND OF THE INVENTION

1. Field of the Invention

This invention relates to microwave phase shifters and more particularly to a reflection type phase shifter.

2. Description of the Prior Art

One example of a 180° phase shifter is described in a publication entitled "Broad-Band 180° Phase Shift Section in X-Band" by T. Yahara et al., IEEE Trans. Microwave Theory Tech., Vol. MTT-23, pp. 307–309, March, 1975. In FIG. 1 thereof a 3 dB coupler is shown having four ports, one for the input signal, one for the output signal, and two ports which are terminated with PIN diodes. A bias voltage is supplied to the diodes to cause them to be conducting or non-conducting. The phase of the microwave signal at the output port is shifted 180° by switching both diodes from the conducting state to the non-conducting state or vice versa. The impedance of the diode $Z_{D-}$ for the reverse biased case, and $Z_{D+}$ for the forward biased case, have some uncertainties requiring some matching circuits to obtain a specified phase shift and have some differences in frequency dependence which decrease the bandwidth of acceptable phase shifts. A two-stub matching circuit is shown coupled between the anode of each diode and its respective port to provide a wideband reflection type 180° phase shift with a center frequency of 9.5 gigahertz and a bandwidth wider than 2 gigahertz.

In the publication by T. Yahara discussed above a 3 dB interdigitated coupler was shown in FIG. 2 and is of the type described by J. Lange in a publication entitled "Interdigitated Strip Line Quadrature Hybrid", IEEE Trans. Microwave Theory Tech., Vol. MTT-17, pp. 1150–1151, December, 1969. The interdigitated coupler provides wide bandwidth performance with very low insertion loss.

A phase shifter of the reflection type which utilizes a conventional branch line quadrature coupler and PIN diodes is described in U.S. Pat. No. 4,205,282 which issued on May 27, 1980 to J. W. Gipprich entitled "Phase Shifting Circuit Element" which is assigned to the assignee herein. In U.S. Pat. No. 4,205,282, parallel line pairs coupled between each port and the diode determine the amount of phase shift at the output of the coupler for the condition of conducting and non-conducting diodes. DC bias is provided to each diode utilizing a high impedance quarter wavelength line and a low impedance subsection to decouple the bias source from the RF circuitry.

The insertion loss through a phase shifter may vary considerably over the range from 0° to 180° phase shift. The variation in insertion loss results from RF power being dissipated in the PIN diodes at times the diodes are conducting as opposed to times when they are non-conducting. The 3 dB coupler used in the phase shifter is essentially lossless and does not contribute significantly to the insertion loss at either 0° or 180° phase shift. The high speed PIN switching diodes used in phase shifters have a narrow junction resulting in high insertion loss when the diodes are conducting. Compensation techniques using impedance transforming resonant circuits at the diode provide acceptable performance over a narrow band only. In addition, the element values associated with impedance transforming resonant circuits are impractical at lower microwave frequencies such as S-band.

It is therefore desirable to provide a phase shifter having substantially equal insertion loss through the phase shifter for both 0° and 180° phase shift.

It is further desirable to provide a phase shifter having wide band performance over at least an octave bandwidth and high speed switching in less than 10 nanoseconds utilizing a "Lange" 3 dB coupler, PIN diodes and chip resistors coupled in shunt across each switching diode.

It is further desirable to provide a phase shifter incorporating diodes, reactive and resistive elements coupled to the diode to compensate for the reactance and variation in resistance of the diode between the conducting and non-conducting condition.

SUMMARY OF THE INVENTION

In accordance with the present invention, a method and apparatus for phase shifting an input microwave signal between at least two phase conditions substantially equal insertion loss in each is described comprising a coupler operable over a wide bandwidth of at least an octave in frequency and having four ports, one of the ports adapted for an input signal, one of the ports adapted for an output signal and two of the ports each having a PIN diode and resistor coupled thereacross to absorb microwave power during times when the diode is non-conducting and a biasing circuit to provide forward and reverse bias to each diode to cause them to be conducting or non-conducting.

DESCRIPTION OF THE PREFERRED EMBODIMENT

Figure 1:
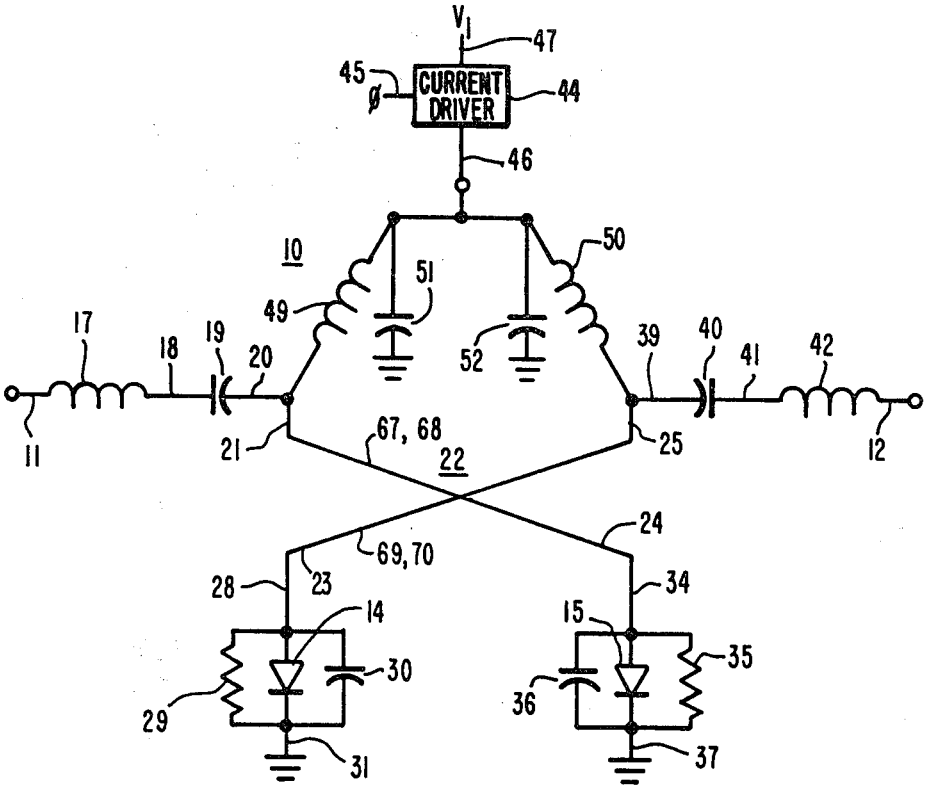
FIG. 1 is a schematic diagram of one embodiment of the invention.

Referring to the drawing and in particular to FIG. 1, a schematic diagram of phase shifter 10 is shown having an input on lead 11 and an output on lead 12. The input signal may for example be a radio frequency (RF) signal or a microwave signal having a frequency in the range from 2.5 to 5.5 gigahertz. For example, other frequency ranges above or below could also be used. Phase shifter 10 is of the reflection type phase shifter to provide approximately 0° or 180° phase shift to the input signal by means of controlling the bias voltage or current to diodes 14 and 15.

The input signal is coupled over lead 11 through inductor 17. Inductor 17 is coupled over lead 18 to one side of capacitor 19. The other side of capacitor 19 is coupled over lead 20 to a first port 21 of coupler 22. Coupler 22 has a second port 23, a third port 24 and a fourth port 25. Coupler 22 may be a broadband interdigitated coupler as described by J. Lange in IEEE Trans. Vol. MTT-17, pp. 1150–1151, December 1969 previously mentioned herein.

The second port 23 of coupler 22 is coupled over lead 28 to the anode of diode 14, one side of resistor 29 and one side of capacitor 30. The other side of resistor 29, capacitor 30 and the cathode of diode 14 are coupled over lead 31 to ground potential.

The third port 24 of coupler 22 is coupled over lead 34 to the anode of diode 15, to one side of resistor 35 and to one side of capacitor 36. The other side of resistor 35, capacitor 36 and the cathode of diode 15 are coupled over line 37 to ground potential.

The fourth port 25 is coupled over lead 39 to one side of capacitor 40. The other side of capacitor 40 is coupled over lead 41 to one side of inductor 42. The other side of inductor 42 is coupled to lead 12.

A bias current or bias voltage is generated by current driver 44. A control signal $\phi$ over lead 45 is coupled to current driver 44 to control the output on lead 46. A voltage source $V_1$ is coupled over lead 47 to current driver 44. The output of current driver 44 is coupled over lead 46 to one side of inductors 49 and 50 and to one side of capacitors 51 and 52. The other side of capacitors 51 and 52 are coupled to ground potential. The other side of inductor 49 is coupled to lead 20 and to the first port 21 of coupler 22. The other side of inductor 50 is coupled to lead 39 and to the fourth port 25 of coupler 22. In phase shifter 10, inductor 17 and capacitor 19 function to provide a high pass filter for the input microwave signal and to prevent the bias current from driver 44 from passing to the input. Likewise, inductor 42 and capacitor 40 provide a high pass filter for passing RF or microwave signals to the output 12 while blocking the bias current from driver 44 from the output.

Inductor 49 and capacitor 51 function as a low pass filter to pass bias current from driver 44 to the first port 21 of coupler 22. Inductor 49 and capacitor 51 block microwave signals from passing to driver 44. Likewise inductor 50 and capacitor 52 function as a low pass filter to pass bias current from driver 44 to the fourth port 25 of coupler 22 and to block microwave signals from passing to driver 44.

Capacitor 30 provides a reactance in shunt across diode 14 to cancel out the inductance reactance across diode 14. Capacitor 36 provides a reactance to cancel out the inductance reactance of diode 15. Capacitors 30 and 36 may for example be a plate capacitor or tuning stub of microstrip material with respect to a ground plane which will be described in more detail with respect to FIG. 2. Resistors 29 and 35 which may for example be 560 ohms each provide a resistive impedance for absorbing power at times when diodes 14 and 15 are non-conducting.

Diodes 14 and 15 may be switched to the conducting state by passing 10 milliamperes of current through each diode. The current is supplied by current driver 44. Diodes 14 and 15 may be switched to the non-conducting state by reverse biasing diodes 14 and 15. Diodes 14 and 15 may be PIN diode type DSM4380 manufactured by Alpha Industries, Inc., 20 Sylvan Road, Woburn, Mass. 01801. The diodes have about 0.2 nanohenries inductance. Resistors 29 and 35 may be chip resistor type MCB manufactured by Film Microelectronics Inc., Burlington, Mass.

Figure 2:
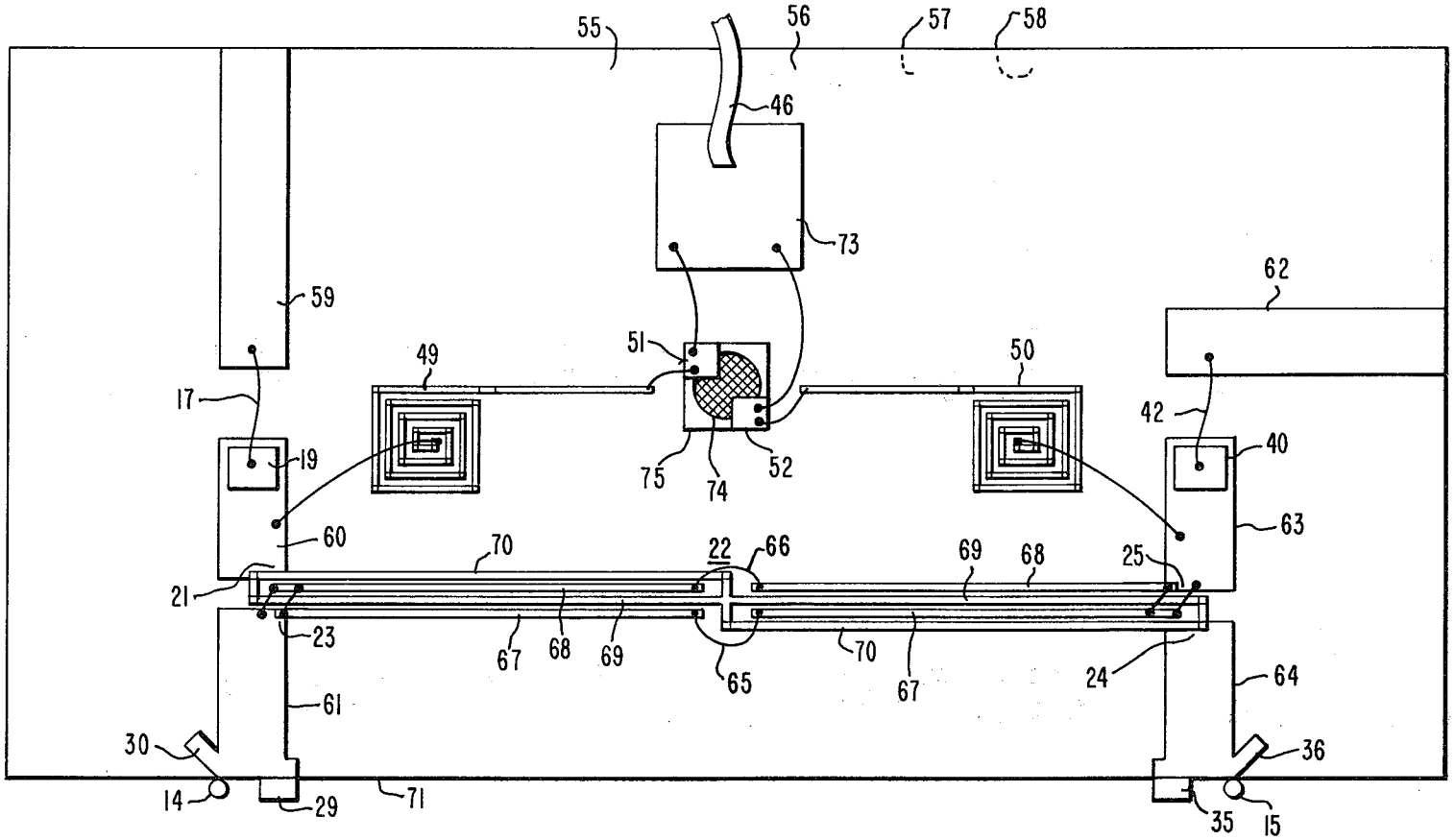
FIG. 2 is a plan view showing the construction of the embodiment in FIG. 1.

FIG. 2 shows the embodiment of FIG. 1 constructed using microstrip techniques on a substrate 55 having an upper surface 56 and a lower surface 57. Lower surface 57 may be metallized with chrome gold to form a metallization layer or ground plane 58 with respect to metallizations on upper surface 56.

The substrate 55 may be alumina and of dimensions 12.7 millimeters long and 6.35 millimeters. Alumina substrate 55 may be 0.635 millimeters thick. On upper surface 56 of substrate 55, a strip of metallization 59 having a width of 0.584 millimeters forms a microstrip line in conjunction with the ground plane 58 on lower surface 57 having a characteristic impedance of 50 ohms, for example. Additional metallizations having a width of 0.584 millimeters on upper surface 56 form microstrip lines as shown by metallizations 60 through 64.

In FIG. 2, like references are used for functions corresponding to those shown in FIG. 1. Capacitor 19 is shown as a chip capacitor in FIG. 2 with one side (its lower surface) bonded to metallization 60 corresponding to lead 20 in FIG. 1 and with the other side (its upper surface) bonded by gold wire 17 which acts as an inductance and conductor corresponding to lead 11 in FIG. 1 which is bonded to metallization 59. Capacitor 40 is shown with one side mounted on metallization 63 corresponding to lead 39 in FIG. 1. The other side of capacitor 40 is coupled with a conductor such as gold wire which also functions as an inductance 42 and is bonded to metallization 62. Metallization 62 corresponds to lead 12 in FIG. 1. Capacitors 19 and 40 may for example be chip capacitors having a capacitance of 2.7 picofarads manufactured by Dielectric Labs, 64 Clinton Road, Fairfield, N.J. 07006. The chip capacitors have a breakdown voltage of at least 50 volts. In FIG. 2 an interdigitated coupler 22 is shown having ports 21, 23, 24 and 25. Metallization strips are formed on upper surface 56 such as bu vacuum deposition of chrome followed by gold. The metallization strips forming coupler 22 are split to enhance coupling. For example, metallizations 67 and 68 are coupled between port 23 and port 25. Metallization 69 and 70 are coupled between port 21 and port 24. Wire bonds 65 and 66 are used to perform conductor crossovers over metallization 70. Additional wire bonds are used to couple metallization 68 to port 23 and metallization 67 to port 25. Electrical contact between the metallized strips and metallizations 60–64 occur where metallizations 67–70 overlap metallizations 60–64.

The length of metallizations 67–70 between metallization lines 60 and 63 or 61 and 64 is a quarter wavelength at the midband or center frequency of the desired frequency range for phase shifter 10. As shown in FIG. 2, coupler 22 is a −3.3 dB interdigitated Lange coupler.

Figure 3:
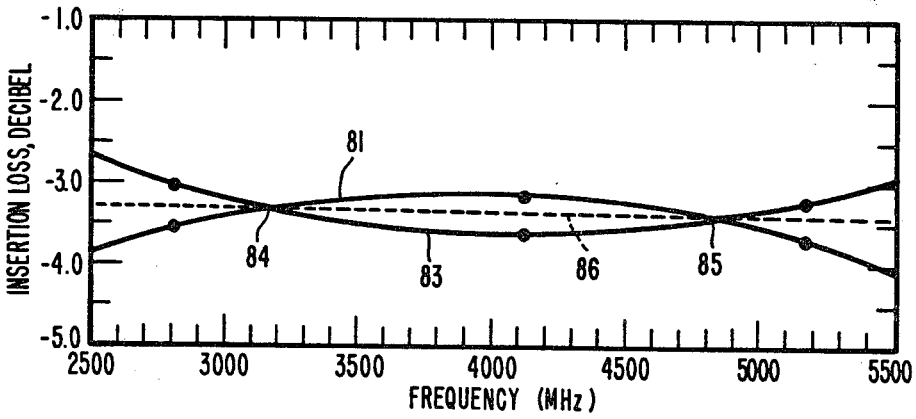
FIG. 3 is a graph of insertion loss over frequency at ports 2 and 3 of the Lange coupler.

FIG. 3 is a graph of the insertion loss through a coupler 22 over frequency. In FIG. 3 the ordinate represents insertion loss and the abscissa represents frequency. An input signal of known power was introduced at port 21. Ports 24 and 25 were terminated with 50 $\omega$ impedances. The signal power was measured at port 23. Curve 81 shows the insertion loss from port 21 to port 23 at 200 MHz increments over the range from 2500 MHz to 5500 MHz.

With an input signal of known power introduced at port 21 and with ports 23 and 25 terminated at 50 $\Omega$ impedance, the signal power was measured at port 24. Curve 83 shows the insertion loss from port 23 to port 24 at 200 MHz increments over the range from 2500 MHz to 5500 MHz.

The characteristics of coupler 22 determine the properties of phase shifter 10 over the desired bandwidth. The Lange coupler is adjusted to adjust the location of the cross-over points 84 and 85 of curves 81 and 83 shown in FIG. 3. Reference line 86 passes through cross-over points 84 and 85. By adjusting the location of points 84 and 85 the insertion loss variation of curve 81 and 83 may be held to within ±0.3 decibels over the range from 2800 MHz to 5200 MHz. The nominal insertion loss as represented by reference line 86 is 3.3 decibels.

In FIG. 2, metallization 61 extends to edge 71 of substrate 55. Diode 14 is coupled between metallization 61 on upper surface 56 and the ground plane metallization 58 on lower surface 57 by using, for example, conductive epoxy. Chip resistor 29 is also coupled across edge 71 of substrate 55 between metallization 61 and the ground plane 58 using conductive epoxy. Capacitor 30 is shown in FIG. 2 as a small strip of metallization or tuning stub positioned above ground plane 58. Metallization 64 extends to edge 71 of substrate 55. Conductive epoxy is used to couple a chip resistor 35 and diode 15 between metallization 64 and ground plane 58 at the edge 71 of substrate 55. Capacitor 36 is formed by metallization or the tuning stub shown in FIG. 2 extending from the metallization 64 in close proximity to diode 15. It is understood that diodes 14 and 15 and chip resistors 29 and 35 are physically mounted to provide the least inductance.

Inductors 49 and 50 are shown formed by a metallization which is laid out in a spiral having one end coupled to either metallization 60 or 63, respectively. Spiral inductors 49 and 50 have an inductance of about 7.5 nanohenries. The other edge of inductors 49 and 50 are coupled with wire bonds to one side of capacitors 51 and 52 and to bonding pad 73 which provides a metallized pad for coupling wire ribbon 46 thereto which leads off substrate 55 for connection to current driver 44. Capacitors 51 and 52 are approximately 5 picofarads in value. Substrate 55 has a mechanical hole 74 for coupling plane 58 to metallized pad 75. Capacitors 51 and 52 have one side bonded with conductive epoxy to metallization 75. Wire ribbon and gold wires coupled ground plane 58 to metallization 75 to provide an electrical ground connection for capacitors 51 and 52 which is very low in inductance.

The embodiment of FIG. 2 was tested by coupling an input signal on microstrip line 59 and measuring the insertion loss and phase shift $\Delta\phi$ at the output on metallization 62. Table I shows the input signal at a plurality of frequencies from 2.5 gigahertz to 5.5 gigahertz in 200 megahertz increments. The insertion loss was measured at the output for the diodes conducting in the "on" or forward bias state and for the diodes non-conducting in the "off" or reverse bias state. The phase shift from the on state to the off state at the output was measured. The diodes were each biased with 10 milliamperes of forward current to place them in the "on" state. Table I shows that a 2.5 gigahertz the on state insertion loss was −2.1 dB and the off state insertion loss was −2.0 dB while the phase shift $\Delta\phi$ was 175°. At 5.5 gigahertz, the on state insertion loss was −2.7 dB and the off state insertion loss was −2.3 dB. The phase shift $\Delta\phi$ was 188°.

TABLE I

| Input Signal Frequency (GHz) | On State Insertion Loss (db) | Off State Insertion Loss (db) | Phase Shift $\Delta\phi$ (Deg.) |
|---|---|---|---|
| 2.5 | −2.1 | −2.0 | 175 |
| 2.7 | −2.1 | −1.9 | 178 |
| 2.9 | −2.1 | −1.9 | 177 |
| 3.1 | −2.1 | −1.9 | 180 |
| 3.3 | −2.1 | −1.9 | 178 |
| 3.5 | −2.4 | −1.9 | 179 |
| 3.7 | −2.4 | −2.0 | 182 |

TABLE I-continued

| Input Signal Frequency (GHz) | On State Insertion Loss (db) | Off State Insertion Loss (db) | Phase Shift $\Delta\phi$ (Deg.) |
|---|---|---|---|
| 3.9 | −2.3 | −1.9 | 182 |
| 4.1 | −2.2 | −2.0 | 183 |
| 4.3 | −2.2 | −2.0 | 183 |
| 4.5 | −2.1 | −2.0 | 184 |
| 4.7 | −2.0 | −2.0 | 184 |
| 4.9 | −1.9 | −1.9 | 185 |
| 5.1 | −2.3 | −2.2 | 184 |
| 5.3 | −2.5 | −2.2 | 187 |
| 5.5 | −2.7 | −2.3 | 188 |

A reflectance type phase shifter has been described utilizing a wide bandwidth coupler and PIN diodes. The insertion loss through the phase shifter has been equalized for the on and off state of the diodes by placing chip resistors in shunt next to the diodes to provide absorption of power at times when the diodes are non-conducting to approximate the power absorbed when the diodes are conducting.

We claim:

1. Apparatus for shifting the phase of microwave signal comprising:

a coupler operable over a wide bandwidth in frequency and having first through fourth ports, said first port adapted for coupling an input microwave signal thereto, said fourth port adapted for coupling an output microwave signal therefrom, a first diode and first resistor coupled across said second port, a second diode and second resistor coupled across said third port, means adapted for coupling a bias current to said first and second diodes whereby the diodes are forward biased during a first time interval and reverse biased during a second time interval, said first and second resistors having a predetermined resistance to absorb microwave power at said diodes during said second time interval to provide substantially the same insertion loss at said fourth port during said first and second time intervals.

2. The apparatus of claim 1 wherein said coupler is an interdigitated strip line.

3. The apparatus of claim 1 wherein said coupler is a Lange coupler.

4. The apparatus of claim 1 further including a first capacitance coupled across said first diode.

5. The apparatus of claim 4 further including a second capacitance coupled across said second diode.

6. The apparatus of claim 1 wherein said first resistor has a resistance substantially equal to the "on" resistance of the first diode.

7. The apparatus of claim 1 wherein said second resistor has a resistance substantially equal to the "on" resistance of the second diode.

8. The apparatus of claim 6 wherein said first resistor has a resistance of 560 Ω.

9. The apparatus of claim 7 wherein said second resistor has a resistance of 560 Ω.

10. A method for providing constant insertion loss through a microwave phase shifter utilizing a 4-port interdigitated strip line coupler comprising the steps of terminating selected ports with a diode in the forward bias condition for a first phase shift, terminating said selected ports with a diode in the reverse biased condition for a second phase shift, and shunting said reverse biased diodes with a resistance having a value substantially equal to the forward biased resistance of the diode it shunts.

* * * * *